US007861986B2

(12) United States Patent
Cline

(10) Patent No.: US 7,861,986 B2
(45) Date of Patent: Jan. 4, 2011

(54) BRACKET AND METHOD FOR SUPPORTING A CUBICLE WALL ON A MOVABLE WALL HAVING HORIZONTAL MOUNTING CHANNELS

(76) Inventor: Jonathan Cline, 9125 E. Purdue Ave., #207, Scottsdale, AZ (US) 85258

( * ) Notice: Subject to any disclaimer, the term of this patent is extended or adjusted under 35 U.S.C. 154(b) by 72 days.

(21) Appl. No.: 12/351,545

(22) Filed: Jan. 9, 2009

(65) Prior Publication Data

US 2009/0294613 A1 Dec. 3, 2009

Related U.S. Application Data

(63) Continuation-in-part of application No. 12/132,454, filed on Jun. 3, 2008, now abandoned.

(51) Int. Cl.
*F16M 11/00* (2006.01)

(52) U.S. Cl. ..... 248/201; 52/36.5; 52/239; 52/713; 211/94.01; 248/220.21

(58) Field of Classification Search ..... 248/201, 248/224.8, 223.31, 225.21, 220.22; 211/94.01, 211/103, 187, 190; 52/36.5, 239, 713; 403/326, 403/329

See application file for complete search history.

(56) References Cited

U.S. PATENT DOCUMENTS

| | | | | |
|---|---|---|---|---|
| 4,979,713 | A * | 12/1990 | Bell | 248/224.8 |
| 7,441,736 | B2 * | 10/2008 | Wiltfang | 248/220.42 |
| 7,655,318 | B2 * | 2/2010 | Hall | 428/542.4 |
| 2003/0201376 | A1 * | 10/2003 | Knight et al. | 248/490 |
| 2004/0118986 | A1 * | 6/2004 | Will et al. | 248/220.22 |
| 2009/0090828 | A1 * | 4/2009 | Junkins | 248/220.21 |

* cited by examiner

*Primary Examiner*—Ramon O Ramirez
(74) *Attorney, Agent, or Firm*—Veronica-Adele R. Cao; Weiss & Moy, P.C.

(57) ABSTRACT

A bracket and method for supporting a cubicle wall on a movable wall having at least one horizontal mounting channel. The bracket has a lower bracket member and at least an upper bracket member that attaches to a movable wall module. A cubicle wall start is then coupled thereto. If a higher cubicle is needed, the bracket will have at least one intermediate bracket member to increase the overall length of the bracket.

20 Claims, 11 Drawing Sheets

BRACKET AND METHOD FOR SUPPORTING A CUBICLE WALL ON A MOVABLE WALL HAVING HORIZONTAL MOUNTING CHANNELS

CROSS-REFERENCE TO RELATED APPLICATION

This application is a continuation-in-part of U.S. application Ser. No. 12/132,454 filed on Jun. 3, 2008 now abandoned in the name of the Applicant to which priority is claimed and which is incorporated herein by reference.

FIELD OF THE INVENTION

This invention relates generally to supporting a cubicle wall on movable walls. More specifically, this invention relates to a bracket and method for supporting a cubicle wall on a movable wall having horizontal mounting channels in a movable wall system.

BACKGROUND OF THE INVENTION

Today's modular/movable wall systems (also called demountable walls) are available in a range of heights and configurations and in every kind of material including traditional drywall, glass, wood, wood composites, steel, etc. Movable wall systems are an environmentally friendly replacement for dry wall or sheet rock, which are most commonly used to create offices and rooms within an office building. Movable walls virtually eliminate construction waste and future renovation waste. Movable walls provide flexibility from the moment the space is built and throughout moves and changes. By industrial definition, a movable wall is a floor-to-ceiling wall just like traditional stud and drywall walls except that it is movable. The walls are built modularly in a factory and installed on-site. Modular wall panels are connected to form the movable wall. Movable walls may be taken down and relocated.

Movable walls may support hanging components such as shelves, cabinets and other furniture, artwork, desktops and other work surfaces, accessories, etc. Conventional vertical wall strips attach with wall fasteners to the movable walls to support the hanging components in a "vertical wall strip system." A vertical wall strip is typically a 3-sided metal strip having vertically spaced mounting openings to receive the wall fasteners, usually spaced 6 to 8 inches apart and a plurality of parallel vertical slots that receive attachment hardware to support the hanging component. Two vertical wall strips are typically required to support a hanging component. Conventional vertical wall strips measure 60 in., 72 in., or 84 in. in height, with the longer wall strips requiring more wall fasteners for attachment to the wall than the shorter wall strips.

Unfortunately, a vertical wall strip system limits the placement of such hanging components at pre-existing vertical points along the movable wall where a vertical wall strip has been attached to the movable wall. The placement of the vertical wall strips is determined during initial design of the interior space limiting the furniture and component shelf-life because their size becomes an issue. In order to address this problem, integrated horizontal mounting channels have now been designed into movable walls allowing for storage and furniture component bearing. The horizontal mounting channels or "antlers" typically run the width of the modular wall panels that form the movable wall and can be placed at any height. A horizontal mounting channel may be positioned at the level of the hanging component to be supported on the movable wall. A plurality of vertically spaced horizontal mounting channels may be disposed in the movable wall or modular panels. Horizontal mounting channels may be formed during fabrication of the panel and/or added or removed on the job site. Until this development, movable walls did not have the horizontal support available to support hanging components. With this development, furniture and storage components have a longer life-cycle because their size is no longer an issue during reconfiguration. Horizontal mounting channels allow the end-user to support hanging components along the horizontal mounting channels i.e. the end-user can go "off-modular." This means that the modular wall panels can be standardized without worrying about the size of the furniture to be attached to the movable wall. The furniture and storage components as well as other hanging components can now hang anywhere along the movable walls, on the vertical and horizontal axes, and not just in pre-existing vertical points determined during initial design of the interior space. A movable wall that incorporates such horizontal mounting channels is referred to herein as a "horizontal wall system."

For example, U.S. Patent Published Application 2006/0059806 filed Aug. 17, 2005 by Gosling et al. incorporated by reference herein describes a reconfigurable movable wall system having at least one wall module having vertical end frames disposed at its side edges, each of the vertical end frames having vertically extending flanges with one extending toward a front surface of the module and the other extending toward a rear surface of the module, a plurality of horizontal stringers (i.e. horizontal mounting channels) affixed between the pair of vertical end frames, an aesthetic surface affixed to the stringers and a removable connecting strip adapted to affix about one of the two flanges to join it to a corresponding flange on a second wall module, a wall bracket, a finishing trim or a connection post. The plurality of horizontal stringers is horizontally spaced at intervals along the height of the module for strength and rigidity. To support hanging components, cantilever channel stringers including a central horizontally extending cantilever channel portion are used. The channel portion has a generally L-shaped slot formed along its length. Stringers that do not include the channel portion can be used anywhere structure is required but the channel portion is not required for supporting hanging components. A conventional movable wall system typically needs five antlers or horizontal stringers for each furniture-bearing wall. A related panel furniture system is also described whereby a work surface or desktop with a substantially L-shaped hook can be received and engage the L-shaped slot of the channel portion to connect the furniture to the module of the movable wall.

While a movable horizontal wall system, such as that described in Gosling et al., offers distinct advantages for movable wall systems, its use has generally been limited to furniture or other hanging components with the L-shaped hook that can engage with the horizontal stringers. For those hanging components conventionally supported on movable walls by a vertical wall strip system, their support on horizontal wall systems has disadvantageously necessitated modifications to the movable walls and/hanging components and/or attachment hardware. Such modifications have been costly, and may compromise the structural integrity of the modified item. For example, modular furniture offered by such manufacturers as Herman Miller are typically incompatible with horizontal wall systems without substantial modification of the walls and/or hanging components and/or attachment hardware because such furniture uses a vertical wall strip system for mounting to a movable wall. The bracket described in Applicant's co-pending application Ser. No. 12/132,454, permits modular furniture to be supported on a movable wall having horizontal mounting channels in a movable wall system.

In addition to supporting modular furniture, the movable wall with horizontal mounting channels may also need to support one or more cubicle walls. Such cubicle walls permit reconfiguration of rooms or the like and generally add to the flexibility of modular wall systems. Unfortunately, movable walls such as that described in Gosling et al. do not permit support of any cubicle walls other than cubicle walls specifically designed for use with the Gosling et al. movable wall system.

Accordingly, there has been a need for a bracket and method for supporting a cubicle wall on a movable wall having at least one horizontal mounting channel. There has also been a need for such a bracket and method that supports the cubicle wall on a movable wall in a manner allowing for weight bearing in both the vertical and horizontal axes. There is a still further need for such a bracket and method that are relatively inexpensive and where the use thereof does not necessitate substantial modification of the movable wall, cubicle wall, or the attachment hardware used to removably attach the cubicle wall. There is a further need for a bracket and method that reduce the number of horizontal mounting channels per furniture bearing wall thus providing both a cost savings and an increase in visual continuity of the modular wall panels. The present invention fulfills these needs and provides other related advantages.

SUMMARY OF THE INVENTION

In accordance with one embodiment of the present invention, a bracket for supporting a cubicle wall on a movable wall having at least one horizontal mounting channel is disclosed. The bracket comprises a lower bracket member having an upper latch portion, a top end with a void, and a lower planar portion; and an upper bracket member having an upper planar portion, and a lower tab portion inserted into the void in the top end of the lower bracket member.

In accordance with another embodiment of the present invention, a bracket for supporting a bracket for supporting a cubicle wall on a movable wall having at least one horizontal mounting channel is disclosed. The bracket comprises a lower bracket member having an upper latch portion, a top end with a recess, and a lower planar portion; at least one intermediate bracket member having an upper latch portion, a top end with a slot, a lower planar portion, and a lower tab portion inserted into the recess in the top end of the lower bracket member; and an upper bracket member having an upper planar portion and a lower tab portion inserted into the slot in the top end of the intermediate bracket member.

In accordance with another embodiment of the present invention, a method for supporting at least one cubicle wall on a movable wall having at least one horizontal mounting channel is disclosed. The method comprises the steps of providing at least one bracket comprising a lower bracket member having an upper latch portion, a top end with a void, and a lower planar portion; and an upper bracket member having an upper planar portion and a lower tab portion inserted into the void in the top end of the lower bracket member; engaging the upper latch portion of the lower bracket member with the horizontal mounting channel; and securing the bracket to the movable wall.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
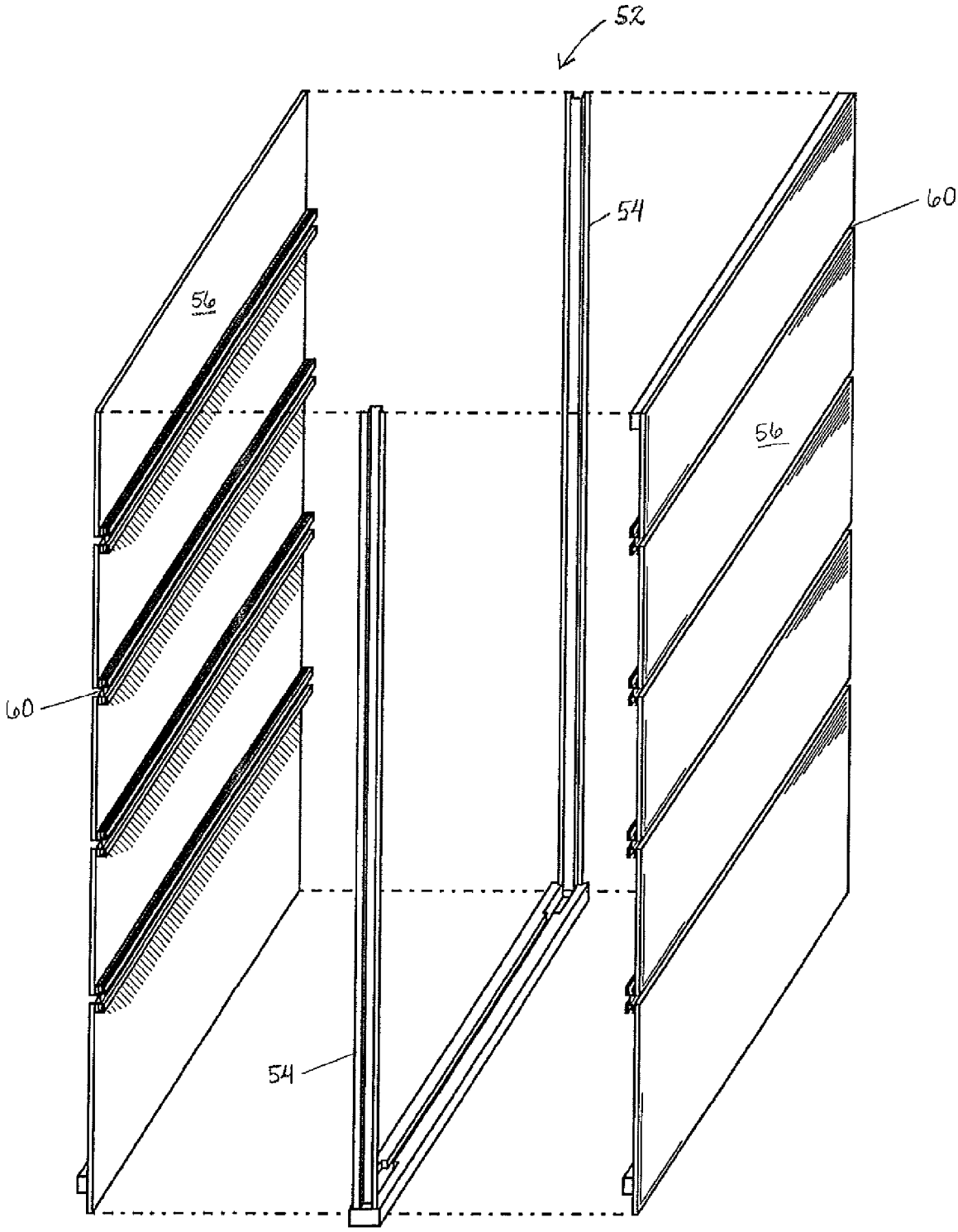
FIG. 1 is an exploded perspective assembly view of a prior art exemplary modular wall panel cladded with wall tile, illustrating the orientation of a plurality of horizontal mounting channels with integrated cantilever channel.

The novel features believed characteristic of the invention are set forth in the appended claims. The invention will best be understood by reference to the following detailed description of illustrated embodiments when read in conjunction with the accompanying drawings, wherein like reference numerals and symbols represent like elements.

FIGS. 1-15 together show a bracket, hereinafter bracket 10, in accordance with the present invention. The bracket 10 permits modular cubicle walls 48 (6B-6D) to be removably attached to movable walls having at least one horizontal mounting channel 60. As known in the prior art, the movable walls may be comprised of at least one wall module 52 or panel such as that shown in FIG. 1 herein. Each wall module 52 generally comprises a pair of vertical end frames 54 that will be spaced apart by the desired width of each wall module 52. The wall modules 52 may be clad with wall tile 56 using a tile clip assembly 58 (see FIGS. 2A-2C) and can be one or two-sided with a finished wall surface on both sides or on one side only. Tiles 56 can be made of wood, plastic, metal fabric glass or other material, and the end frames 54 may be interconnected by a plurality of horizontal mounting channels 60.

Figure 2A:
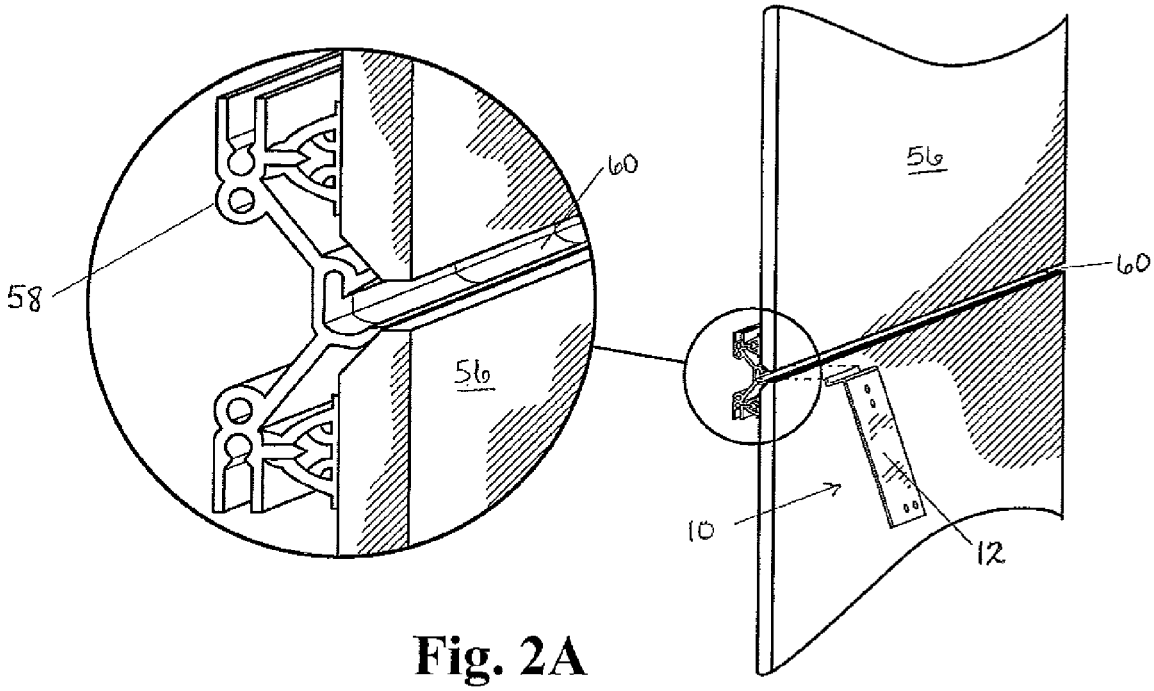
FIG. 2A is an enlarged view of a portion of one of the prior art horizontal mounting channels with cantilever bracket details and tile clip connection details, illustrating an upper latch portion of a lower bracket member embodying the invention engaging with the horizontal mounting channel.

A component bearing wall 30 or modular wall panel 16 may have four horizontal mounting channels 60 as shown in FIG. 1, although more or less horizontal mounting channels 60 may be used. The placement of the horizontal mounting channels 60 depends on the furniture configuration. While a particular configuration of a movable wall/movable wall module 52 has been described and shown, it is to be appreciated that the bracket 10 may be used with movable walls and movable wall modules 52 having other configurations.

The bracket 10 comprises a lower bracket member 12 and an upper bracket member 30. The lower bracket member 12 has an upper latch portion 14 and a lower planar portion 18. In one embodiment, the upper latch portion 14 of the lower bracket member 12 is an L-shaped flange with rearwardly and upwardly extending portions; wherein the rearwardly extending portion is parallel to the floor and the upwardly extending portion is perpendicular to the floor. The upper latch portion 14 is inserted into the horizontal mounting channel 60 and engages the tile clip assembly 58. It should be clearly understood that the upper latch portion 14 may have an alternate shape, as long as it will securely engage the tile clip assembly 58.

The lower planar portion 18 of the lower bracket member 12, according to one embodiment, may be rectangular. It should be clearly understood that substantial benefit may be derived from the lower planar portion 18 having any suitable shape. When the upper latch portion 14 is engaged with the tile clip assembly 58, a rear side of the lower planar portion 18 will rest flat against the wall module 52. The lower planar portion 18 will thus be perpendicular to the floor.

Figure 2B:
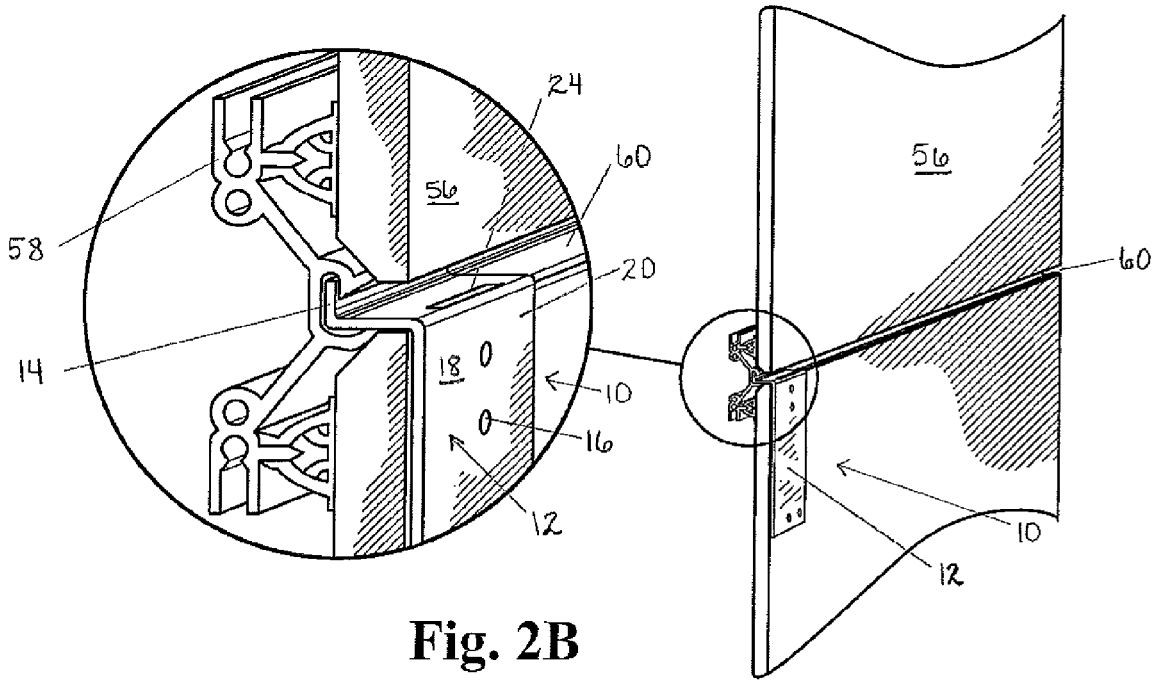
FIG. 2B is an enlarged view similar to FIG. 2A, illustrating the upper latch portion of the lower bracket member of FIG. 2A engaged with the prior art horizontal mounting channel of FIG. 2A.
Figure 4A:
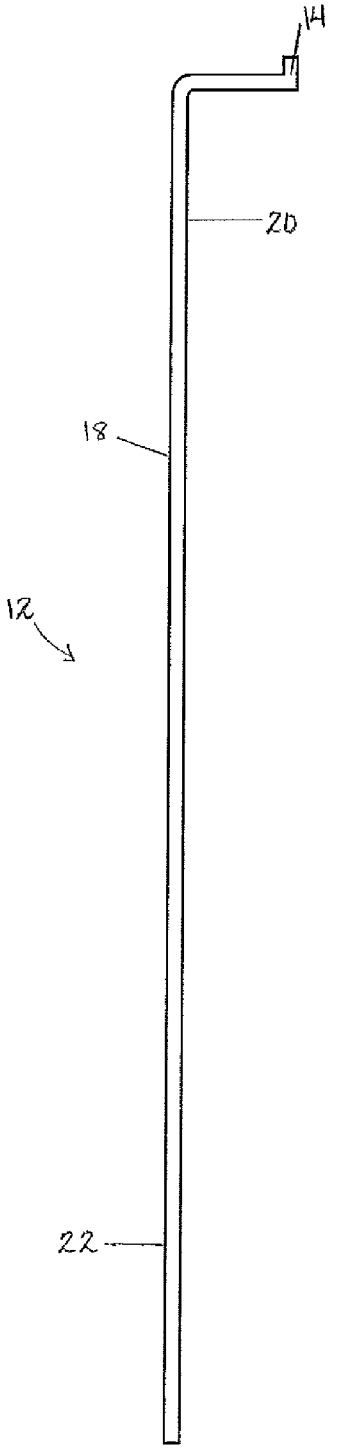
FIG. 4A is a side view of the lower bracket member, illustrating an upper latch portion and a lower planar portion.
Figure 4B:
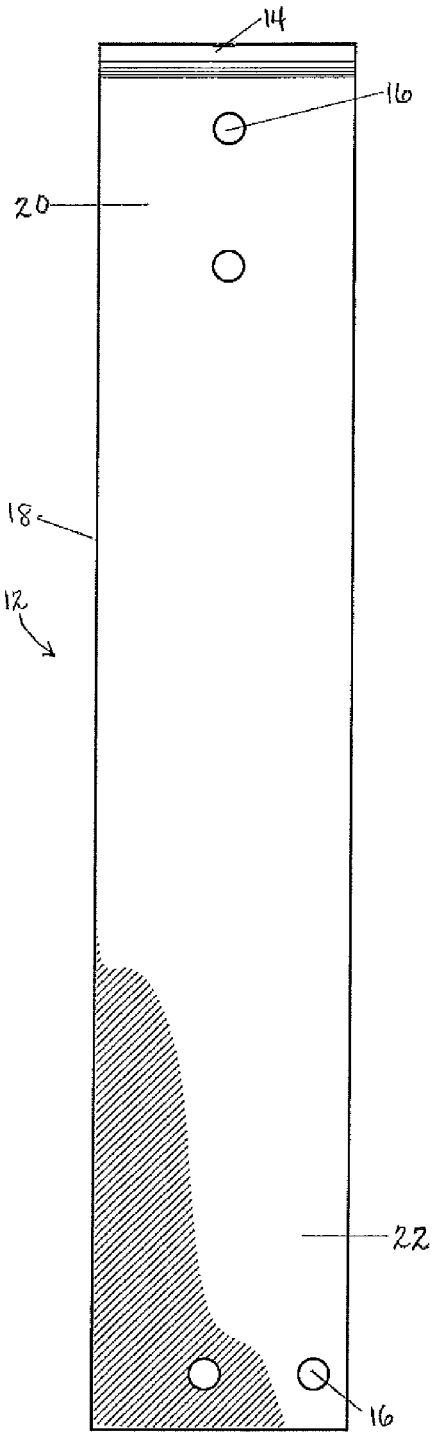
FIG. 4B is a front elevational view of the lower bracket member of FIG. 4A, illustrating a plurality of vertically aligned openings near a top area of the lower planar portion and a plurality of openings in a bottom area of the lower planar portion.
Figure 4C:
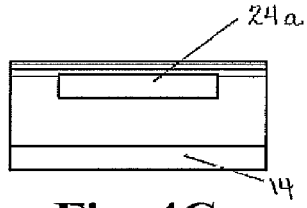
FIG. 4C is a top view of the lower bracket member of FIG. 4B, illustrating the slot in the top end of the lower bracket member.
Figure 4D:
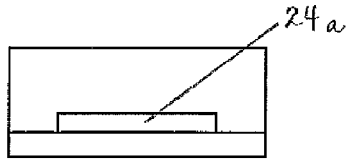
FIG. 4D is a mirror image top view of the lower bracket member of FIG. 4C.
Figure 5A:
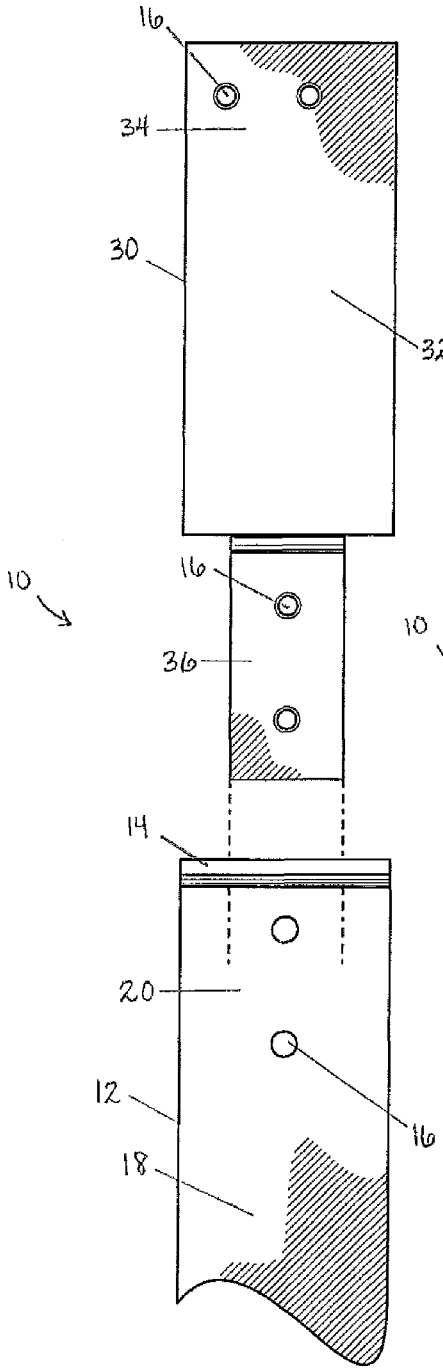
FIG. 5A is an assembly view of the bracket, illustrating the manner in which the lower tab portion of the upper bracket member slidably engages into the slot in the top end of the lower bracket member to form the bracket.
Figure 5B:
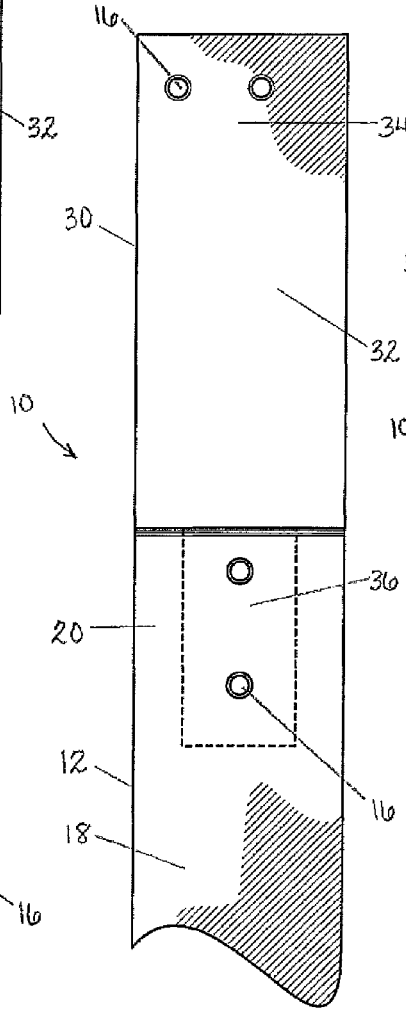
FIG. 5B is a front elevational view of the bracket of FIG. 5A, illustrating the lower tab portion of the upper bracket member in dotted lines within the slot.
Figure 5C:
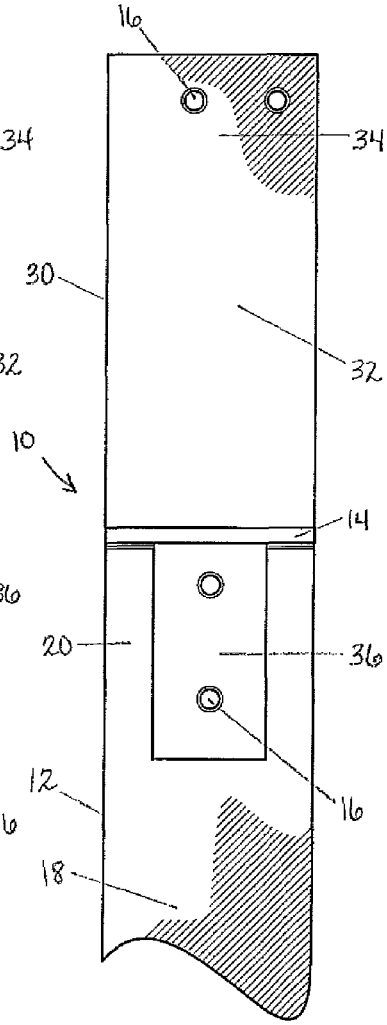
FIG. 5C is a rear elevational view of the bracket of FIGS. 5A and 5C.

As shown in FIG. 2B, 4C and 4D, there is a void 24 in a top end of the lower bracket member 12. Where the upper latch portion 14 of the lower bracket member 12 is an L-shaped flange, the void 24 will be formed in the rearwardly extending portion of the L-shaped flange. The void 24 will be formed proximate the meeting point of the rearwardly extending portion and the lower planar portion 18 so that the void 24 is positioned anterior to the front surface of the wall module 52. In the embodiment shown in FIGS. 2A-6D, the void 24 may be a slot 24*a* that is rectangular with four sides (see FIGS. 2B, 4C, and 4D). In another embodiment shown in FIGS. 7-15, the void 24 may be a recess 24*b* (see FIG. 13).

The upper bracket member 30 has an upper planar portion 32 which, according to one embodiment, may be rectangular. It should be clearly understood that substantial benefit may be derived from the upper planar portion 32 having any suitable shape. The upper bracket member 30 also has a lower tab portion 36. As shown in FIGS. 2C, 5A, 5B, and 5C, the lower tab portion 36 is sized to be inserted into the slot 24*a* in the top end of the lower bracket member 12. When the lower tab portion 36 is inserted into the slot 24*a*, a rear side of the upper bracket member 30 will rest flat against the wall module 52; thus being perpendicular to the floor.

According to another embodiment, shown in FIGS. 7-15, the bracket 10 may also have an intermediate bracket member 40. The use of an intermediate bracket member 40 will increase the size of the bracket 10 as a whole so that it may be used to mount a cubicle wall 48 of greater height. The intermediate-bracket member 40 will have an upper latch portion 42 and a lower planar portion 46. Similar to the upper latch portion 14 of the lower bracket member 12, the upper latch portion 42 of the intermediate bracket member 40 may be an L-shaped flange with rearwardly and upwardly extending portions; wherein the rearwardly extending portion is parallel to the floor and the upwardly extending portion is perpendicular to the floor. Also in similar fashion, the upper latch portion 42 is inserted into a horizontal mounting channel 60 above the horizontal mounting channel 60 that is engaged by the upper latch portion 14 of the lower bracket member 12 and engages the tile clip assembly 58.

Figure 12:
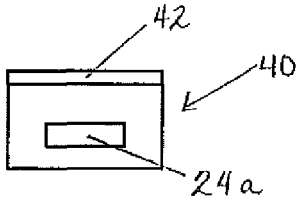
FIG. 12 is a top view of the intermediate bracket member of FIG. 9, illustrating a slot in the top end adapted to receive the lower tab portion of the upper bracket member.
Figure 10:
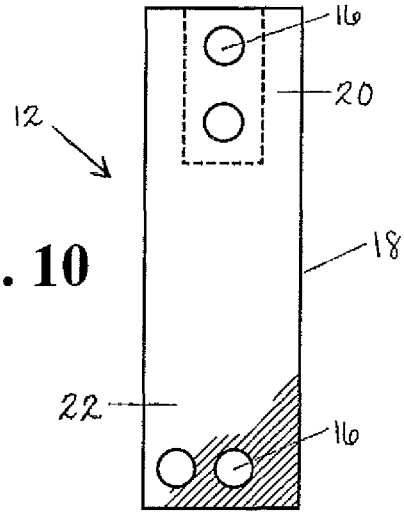
FIG. 10 is a front view of the lower bracket member of the bracket of FIG. 7.
Figure 13:
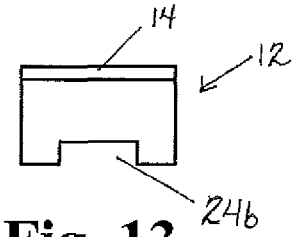
FIG. 13 is a top view of the lower bracket member of FIG. 10, illustrating a recess at a top end adapted to receive the lower tab portion of the intermediate bracket member.

As shown in FIG. 12, there is a void 24 in a top end of the intermediate bracket member 12. It is similar to the slot 24*a* formed in the top end of the lower bracket member 12 of the embodiment shown in FIGS. 2A-6D. In other words, where the upper latch portion 42 of the intermediate bracket member 40 is an L-shaped flange, the void 24 will be formed in the rearwardly extending portion of the L-shaped flange. The void 24 will be formed proximate the meeting point of the rearwardly extending portion and the lower planar portion 46 so that the void 24 is positioned anterior to the front surface of the wall module 52.

Figure 7:
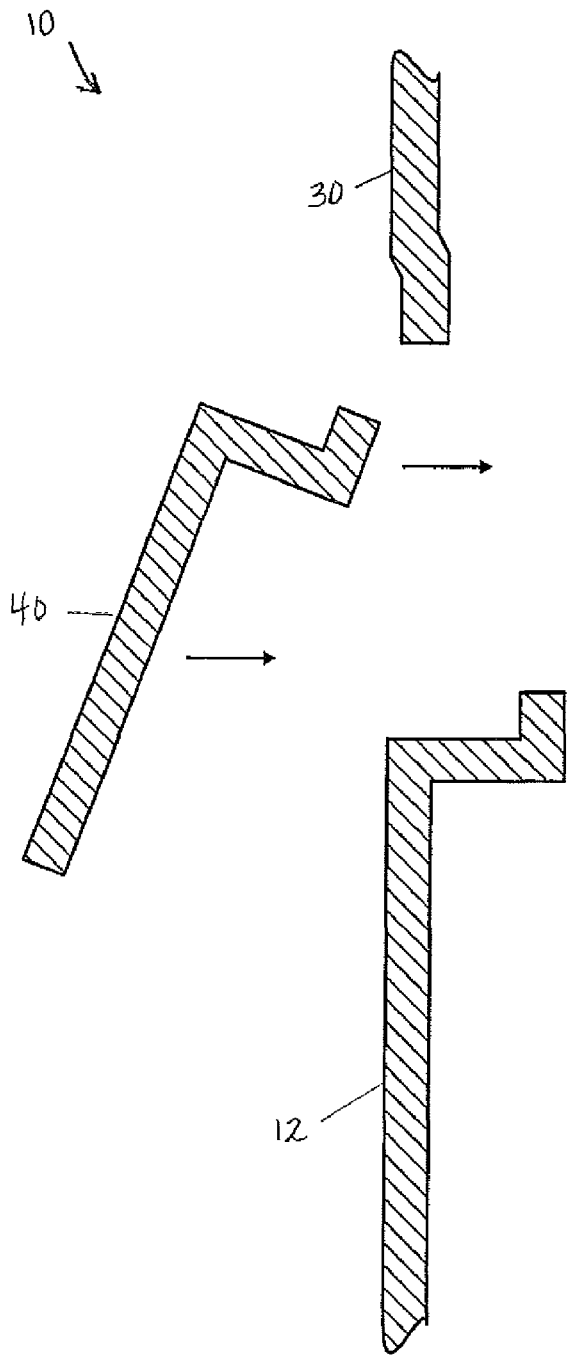
FIG. 7 is a sectional assembly view of another embodiment of the bracket.
Figure 7A:
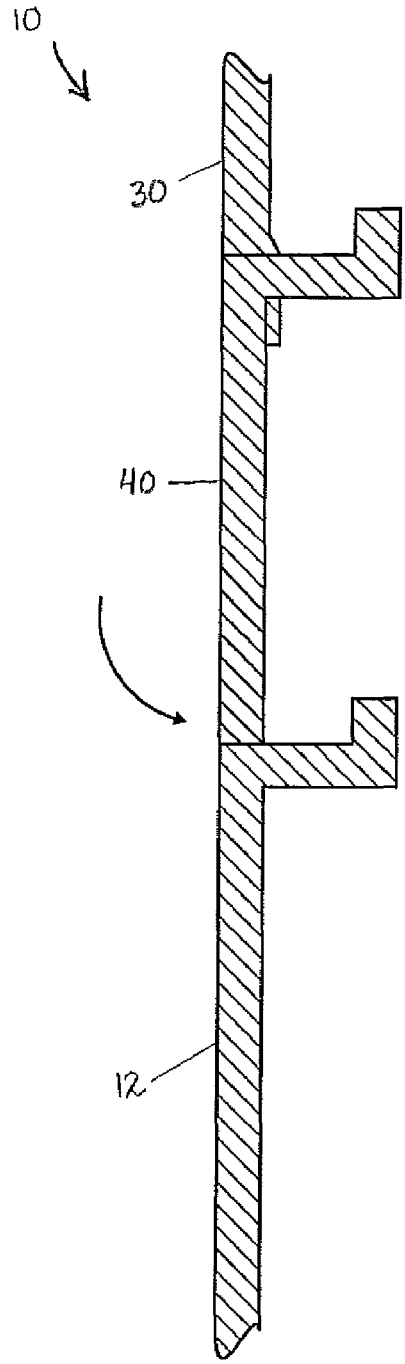
FIG. 7A is a sectional view of the assembled bracket of FIG. 7, illustrating engagement of a intermediate bracket member with the upper bracket member of FIG. 3A and a lower bracket member.
Figure 8:
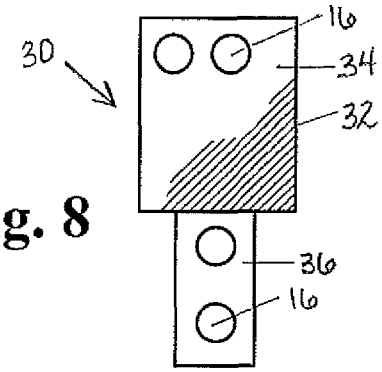
FIG. 8 is a front view of the upper bracket member of the bracket of FIG. 7.
Figure 11:
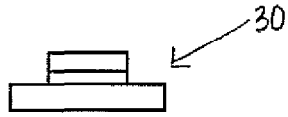
FIG. 11 is a top view of the upper bracket member of FIG. 8.
Figure 9:
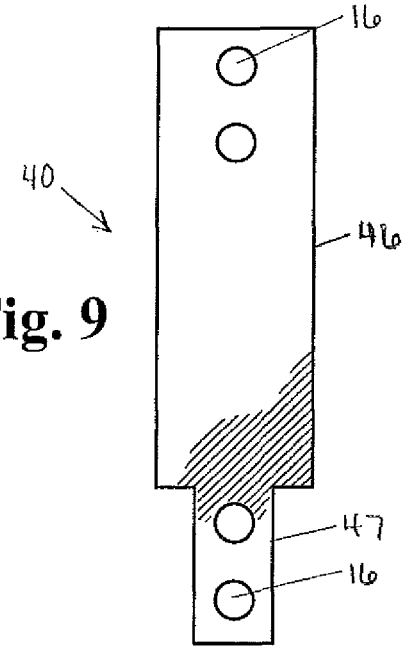
FIG. 9 is a front view of the intermediate bracket member of the bracket of FIG. 7.
Figure 14:
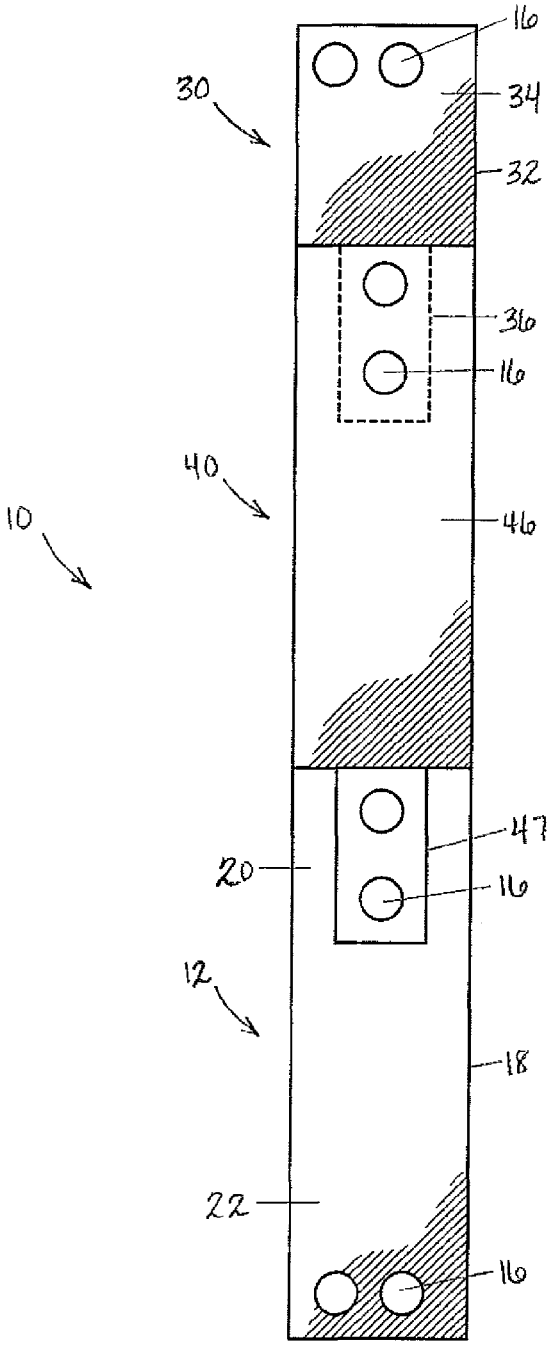
FIG. 14 is a front elevational view of the bracket of FIG. 7A illustrating the manner in which the lower tab portion of the upper bracket member slidably engages the slot in the top end of the intermediate bracket member (the tab is shown in dotted lines) and the manner in which the lower tab portion of the intermediate bracket member engages the recess in the top end of the lower bracket member.
Figure 15:
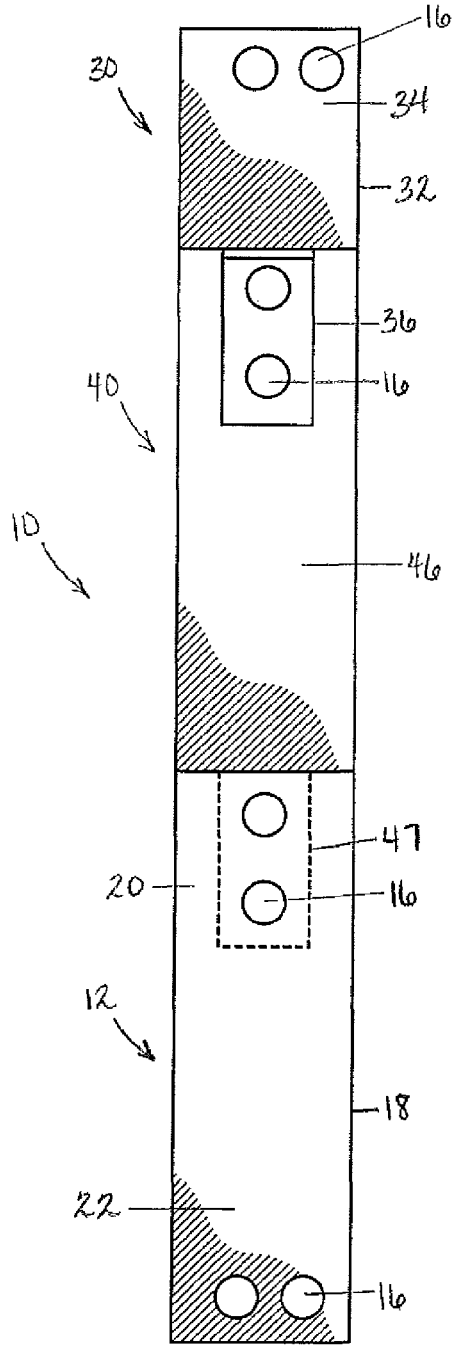
FIG. 15 is a rear elevational view of the bracket of FIG. 14 with the lower tab portion of the intermediate bracket member shown in dotted lines.

The intermediate bracket member 40 also has a lower tab portion 47. As shown in FIG. 7A, 14, and 15, the lower tab portion 47 is sized to be inserted into the recess 24*b* in the top end of the lower bracket member 12. When the lower tab portion 47 is inserted into the recess 24*b*, a rear side of the intermediate bracket member 40 will rest flat against the wall module 52; thus being perpendicular to the floor. While in this embodiment, the void 24 in the lower bracket member 12 is shown as being a recess 24*b*, it should be clearly understood that substantial benefit may still be derived if the void 24 in this embodiment is a slot 24*a*.

In the embodiment shown in FIGS. 2A-6D, the lower planar portion 36 of the lower bracket member 12 has at least one opening 16 that aligns with at least one opening 16 in the lower tab portion 36 of the upper bracket member 30 when the lower tab portion 36 is inserted into the slot 24*a* in the top end of lower bracket member 12. As shown in FIGS. 5A-5C, these openings 16 are located in a top area 20 of the lower planar portion 18 of the lower bracket member 12. When the openings 16 in the top area 20 of the lower planar portion 18 of the lower bracket member 12 are aligned with the openings 16 in the lower tab portion 36 of the upper bracket member 30, a fastener 28 may be inserted through the openings 16. This will removably secure the lower bracket member 12 and the upper bracket member 30 together and will also secure the entire bracket 10 to the wall module 52 (see FIG. 2C).

In the embodiment shown in FIGS. 7-15, at least one opening 16 in the top area 20 of the lower planar portion 18 of the lower bracket member 12 aligns with at least one opening 16 in the lower tab portion 47 of the intermediate bracket member 40 when the lower tab portion 47 of the intermediate bracket member is inserted into the recess 24*b* in the top end of the lower bracket member 12. The intermediate bracket member 40 also has at least one opening 16 in its lower planar portion 46 that aligns with the opening 16 in the lower tab portion 36 of the upper bracket member 30 when the lower tab portion 36 of the upper bracket member 30 is inserted into the slot 24*a* in the top end of the intermediate bracket member 40. When the opening 16 in the top area 20 of the lower planar portion 18 of the lower bracket member 12 is aligned with the opening 16 in the lower tab portion 47 of the intermediate bracket member 40 and when the opening 16 in the lower planar portion 46 of the intermediate bracket member 40 is aligned with the opening 16 in the lower tab portion 36 of the upper bracket member 30, a fastener 28 may be inserted through the openings 16. This will removably secure the lower bracket member 12 to the intermediate bracket member 40 and secure the intermediate bracket member 40 to the upper bracket member 30. It will also secure the entire bracket 10 to the wall module 52.

The openings 16 may be punched, drilled, or otherwise formed in the bracket 10. Though not required, the openings 16 may also be pre-threaded to receive a threaded fastener such as a screw (see FIG. 6A). For example, in a preferred embodiment, pre-threaded PEM® nuts 54 may be pressure or snap fitted into the bracket openings 20 and the bracket openings with PEM® nuts are collectively referred to herein as "pre-threaded PEM® nut openings." While the use of PEM® nut openings and machine screws are described, it is to be appreciated that other types of threaded openings and fasteners may be used within the confines of the invention. Furthermore, while the openings 16 in the lower tab portion 36 of the upper bracket member 30, the lower tab portion 47 of the intermediate bracket member 40, the top area 20 of the lower planar portion 18 of the lower bracket member 12, and the lower planar portion 46 of the intermediate bracket member 12 are shown as being two vertically aligned openings 16, it should be clearly understood that any suitable configuration and number of openings 16 may be used.

Figure 6A:
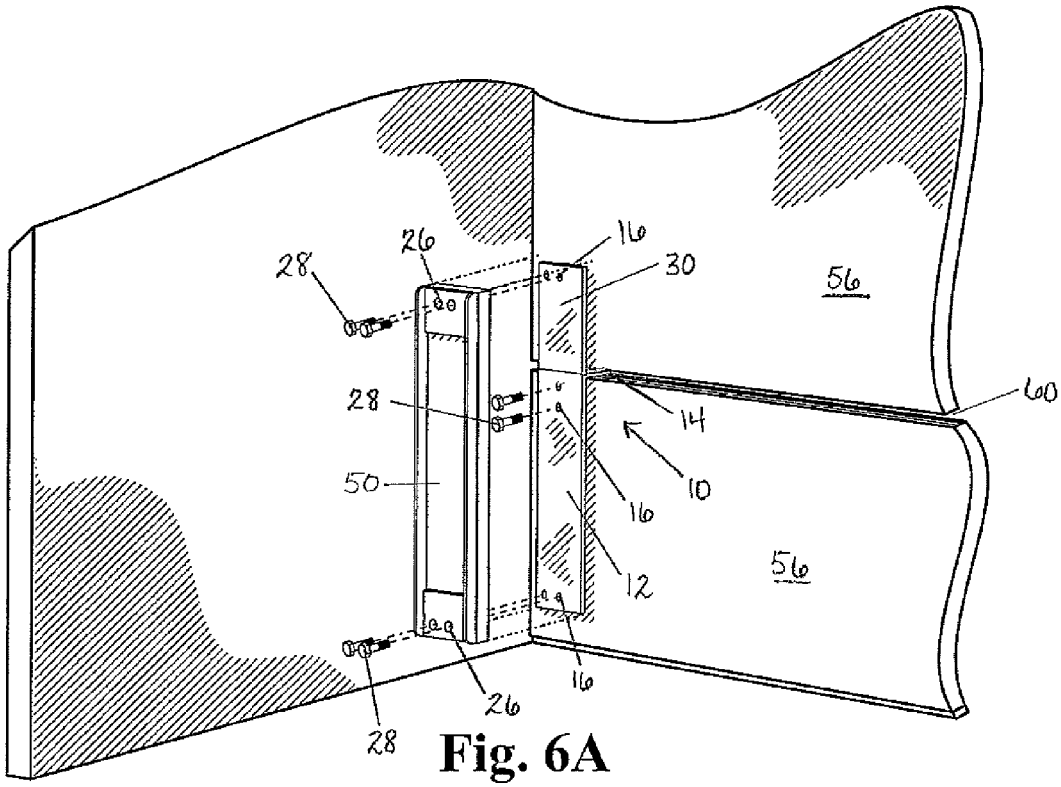
FIG. 6A is a perspective environmental view of an exemplary modular wall panel, illustrating the lower bracket member of FIG. 2A engaged in the horizontal mounting channel in the modular wall panel with the upper bracket member being fastened by a pair of screws to the lower bracket member to form the bracket with a cubicle wall start being removably fastened with screws to the bracket.
Figure 6B:
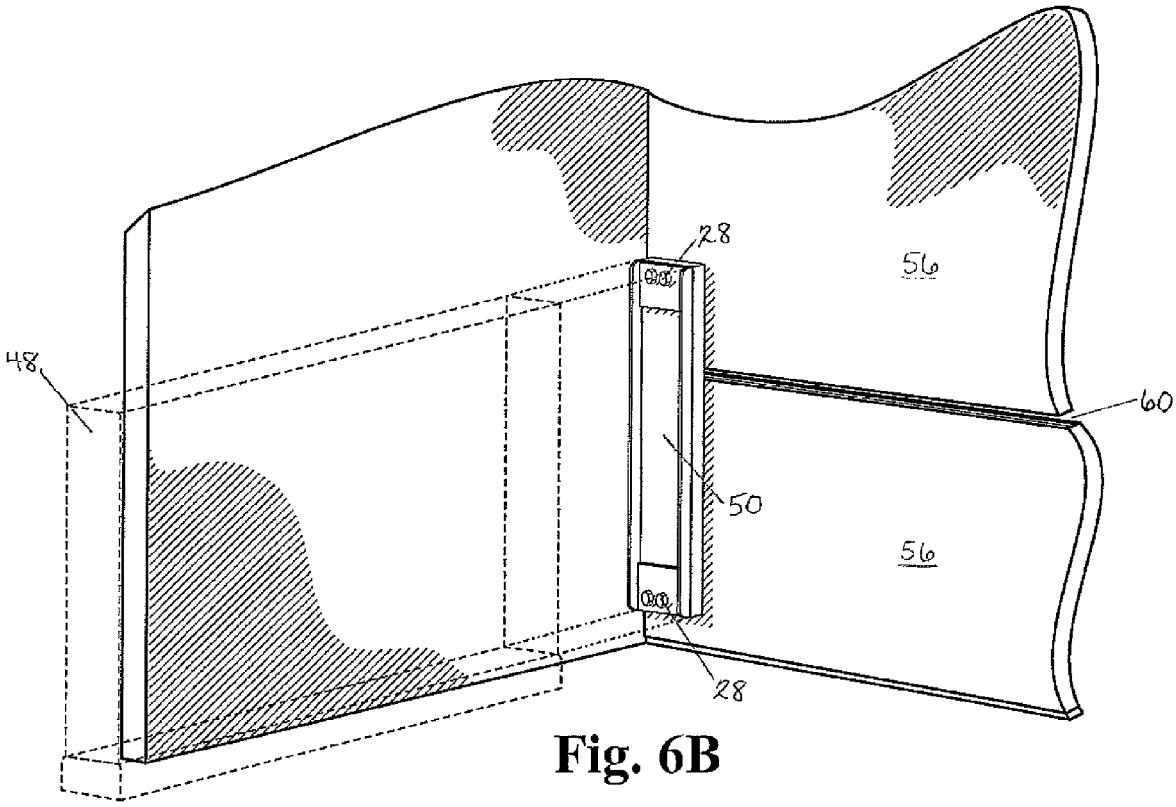
FIG. 6B is a perspective environmental view of an exemplary modular wall panel illustrating a conventional exemplary cubicle wall in dotted lines engaging with the conventional cubicle wall start.
Figure 6C:
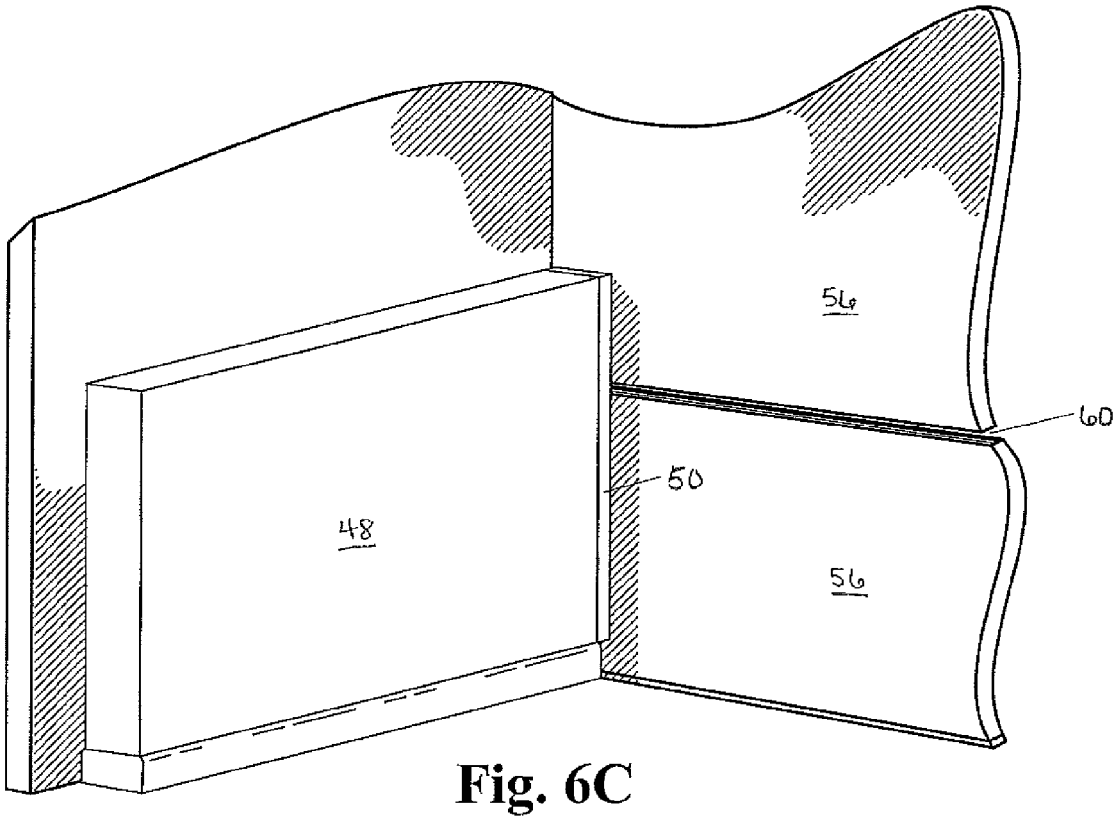
FIG. 6C is another perspective environmental view of the cubicle wall of FIG. 6B removably attached to the modular wall.
Figure 6D:
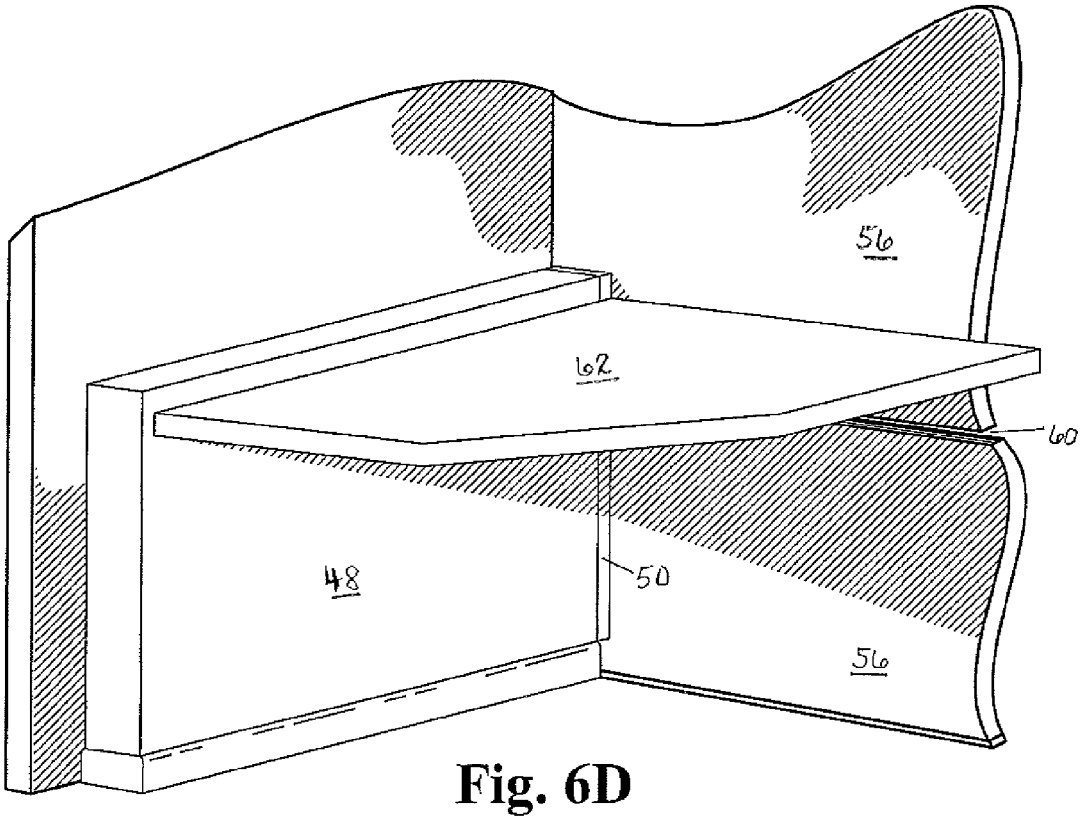
FIG. 6D is another perspective environmental view similar to FIG. 6C, illustrating a tabletop removably attached to the cubicle and modular walls of FIG. 6C.

In a preferred embodiment as shown in FIGS. 3A, 4B, 8, and 10, there is at least one opening 16 in a top area 34 of the upper planar portion 32 of the upper bracket member 30. There is also at least one opening 16 in a bottom area 22 of the lower planar portion 13 of the lower bracket member 12. As shown in FIGS. 6A and 6B, these openings 16 will align with corresponding upper and lower openings 26 in a cubicle wall start 50. Fasteners 28 may be inserted through the openings 16, thus securing the cubicle wall start 50 to the bracket 10 and to the wall module 52. The spacing and number of openings 16 may vary depending on component configuration.

Statement of Operation

Figure 2C:
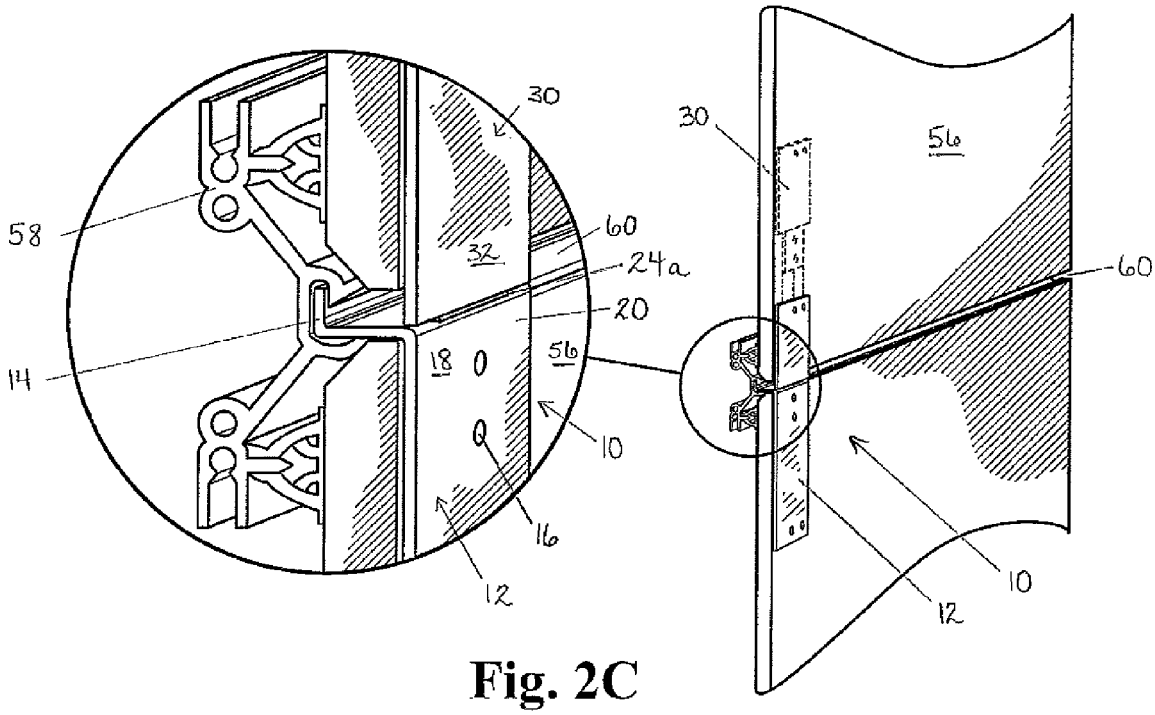
FIG. 2C is an enlarged view similar to FIGS. 2A and 2B, illustrating an upper bracket member having a lower tab portion slidably engaging into a slot in the top end of the lower bracket member to form the bracket.
Figures 3A, 3B, 3C, 3D:
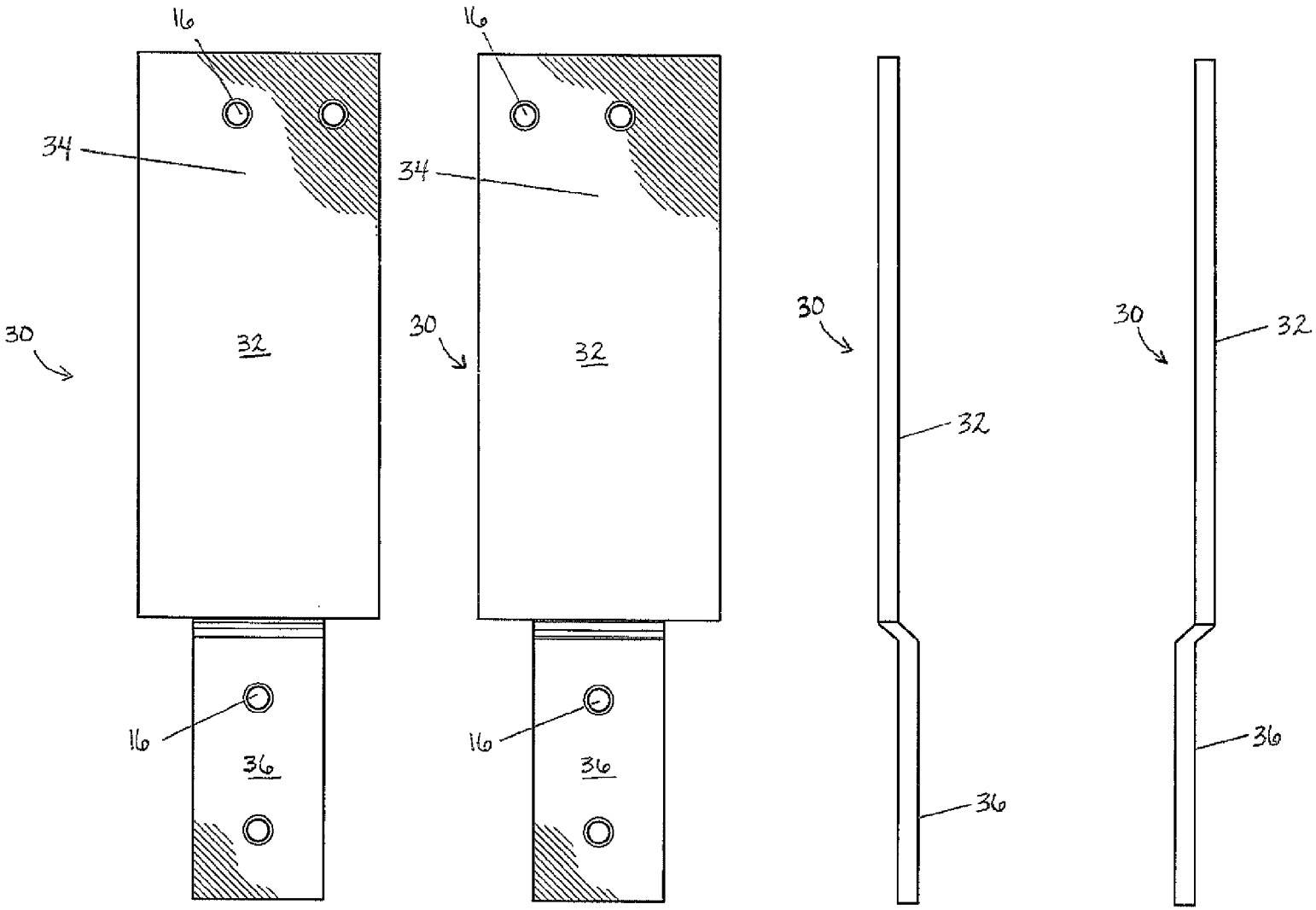
FIG. 3A is a front elevational view of the upper bracket member, illustrating a plurality of vertically aligned openings in the lower tab portion and a plurality of openings in top area of the upper planar portion.
FIG. 3B is a rear elevational view of the upper bracket member of FIG. 3A.
FIG. 3C is a side view of the upper bracket member of FIGS. 3A and 3B.
FIG. 3D is an opposing side view of the upper bracket member of FIG. 3C.

In the method of the invention, the upper latch portion 14 of the lower bracket member 12 (and similarly the upper latch portion 42 of the intermediate bracket member 40) may be received in and engage a horizontal mounting channel 60 as shown in FIGS. 2B and 2C. The substantially L-shaped flange may be inserted into the horizontal mounting channel 60 with the upwardly extending portion of the substantially L-shaped flange behind a top front edge of the horizontal mounting channel 60. The lower bracket member 12 is then swung downwardly toward the wall tile 56 until the rearwardly extending portion of the substantially L-shaped flange is seated over the lower bottom edge of the horizontal mounting channel 60. At this point, the lower bracket member 12 (or intermediate bracket member 40) is now engaged with the horizontal mounting channel 60 and may be slid horizontally anywhere along the length of the channel 60 to any position. The engaged lower bracket member 12 (or intermediate bracket member 40) hangs from the horizontal mounting channel 60 substantially flat against the wall tiles 56 of one or more modular wall panels 52 whereby the lower planar portion 18 of the lower bracket member 12 (or lower planar portion 46 of the intermediate bracket member 40) is disposed substantially perpendicular to the floor.

The bracket 10 may then be assembled by inserting the lower tab portion 36 of the upper bracket member 30 into the slot 24*a* in the lower bracket member 12, aligning the openings 12 of the lower bracket member 12 with the upper bracket member 30 and securing them to the wall module 52 with a fastener 28. If a larger bracket 10 is desired, then the lower tab portion 47 of the intermediate bracket member 40 will be inserted into the recess 24*b* in the lower bracket member 12 and the lower tab portion 36 of the upper bracket member 30 will be inserted into the slot 24*a* in the top end of the intermediate bracket member 40. The openings 12 of the lower bracket member 12, the intermediate bracket member 30, and the upper bracket member 30 will be properly aligned and the bracket will be secured to the wall module 52 with fasteners 28 through the openings 12. A cubicle wall start 50 will then be coupled to the bracket 10 with standard attachment hardware. A cubicle wall 48 may then be coupled to the cubicle wall start 50 and other furniture components (such as a tabletop 62 shown in FIG. 6D) may be added on.

For reconfiguring the space, the cubicle wall 48 and attachment hardware may be removed from the cubicle wall start 50 and wall module 52 in the conventional manner. The fasteners 28 may be removed from the aligned bracket 10 and openings 12 to unfasten the wall start 50 from the respective bracket(s) 10. To remove the bracket 10 from the horizontal mounting channel 60, the bracket 10 may be tilted upwardly and rotated so that the substantially L-shaped flange may be withdrawn from the horizontal mounting channel 60.

From the foregoing, it is to be appreciated that the bracket 10 and method permit support of modular cubicle walls 48 on movable walls having horizontal mounting channels 60 substantially eliminating the need for modification of the movable wall, cubicle wall or wall start, or attachment hardware.

While the invention has been particularly shown and S described with reference to preferred embodiments thereof, it will be understood by those skilled in the art that the foregoing and other changes in form and details may be made therein without departing from the spirit and scope of the invention.

I claim:

1. A bracket for supporting a cubicle wall on a movable wall having at least one horizontal mounting channel comprising:
- a lower bracket member having:
  - an upper latch portion;
  - a top end with a void; and
  - a lower planar portion; and
- an upper bracket member having:
  - an upper planar portion; and
  - a lower tab portion inserted into the void in the top end of the lower bracket member;
- wherein the upper planar portion of the upper bracket member and a bottom area of the lower planar portion of the lower bracket member each has at least one opening to receive a fastener.

2. The bracket of claim 1 wherein the upper latch portion of the lower bracket member is an L-shaped flange.

3. The bracket of claim 2 wherein the L-shaped flange has a rearwardly extending portion and an upwardly extending portion.

4. The bracket of claim 1 wherein the lower tab portion of the upper bracket member has at least one opening that aligns with at least one corresponding opening in a top area of the lower planar portion of the lower bracket member when the lower tab portion of the upper bracket member is inserted into the void in the top end of the lower bracket member.

5. The bracket of claim 4 wherein the openings are prethreaded to receive a threaded fastener.

6. The bracket of claim 1 wherein the opening in the upper planar portion of the upper bracket member and the opening in the bottom area of the lower planar portion align with corresponding upper and lower openings in a cubicle wall start.

7. The bracket of claim 1 further comprising at least one intermediate bracket member having:
- an upper latch portion;
- a top end with a void to receive the lower tab portion of the upper bracket member;
- a lower planar portion; and
- a lower tab portion inserted into the void in the top end of the lower bracket member.

8. The bracket of claim 7 wherein the lower planar portion of the intermediate bracket member has at least one opening that aligns with at least one corresponding opening in the lower tab portion of the upper bracket member when the lower tab portion of the upper bracket member is inserted into the void in the top end of the intermediate bracket member.

9. The bracket of claim 7 wherein the lower tab portion of the intermediate bracket member has at least one opening that aligns with at least one corresponding opening in a top area of the lower planar portion of the lower bracket member when the lower tab portion of the intermediate bracket member is inserted into the void in the top of the lower bracket member.

10. A bracket for supporting a cubicle wall on a movable wall having at least one horizontal mounting channel comprising:
- a lower bracket member having:
  - an upper latch portion;
  - a top end with a recess; and
  - a lower planar portion;
- at least one intermediate bracket member having:
  - an upper latch portion;
  - a top end with a slot;
  - a lower planar portion; and
  - a lower tab portion inserted into the recess in the top end of the lower bracket member; and
- an upper bracket member having:
  - an upper planar portion; and
  - a lower tab portion inserted into the slot in the top end of the intermediate bracket member.

11. The bracket of claim 10 wherein the lower tab portion of the upper bracket member has at least one opening that aligns with at least one opening in the lower planar portion of the intermediate bracket member when the lower tab portion of the upper bracket member is inserted into the slot of the intermediate bracket member.

12. The bracket of claim 10 wherein the lower tab portion of the intermediate bracket member has at least one opening that aligns with at least one opening in a top area of the lower planar portion of the lower bracket member when the lower tab portion of the intermediate bracket member is inserted into the recess of the lower bracket member.

13. The bracket of claim 10 wherein a top area of the upper planar portion of the upper bracket member has at least one opening that aligns with at least one upper opening in a cubicle wall start and wherein a bottom area of the lower planar portion of the lower bracket member has at least one opening that aligns with at least one lower opening in a cubicle wall start.

14. The bracket of claim 10 wherein the upper latch portion of the intermediate bracket member and the upper latch portion of the lower bracket member each is an L-shaped flange, the L-shaped flange having a rearwardly extending portion and an upwardly extending portion.

15. A method for supporting at least one cubicle wall on a movable wall having at least one horizontal mounting channel comprising the steps of:
- providing at least one bracket comprising:
  - a lower bracket member having:
    - an upper latch portion;
    - a top end with a void; and
    - a lower planar portion; and
  - an upper bracket member having:
    - an upper planar portion; and
    - a lower tab portion inserted into the void in the top end of the lower bracket member;
- engaging the upper latch portion of the lower bracket member with the horizontal mounting channel; and
- securing the bracket to the movable wall.

16. The method of claim 15 wherein the step of securing the bracket to the movable wall comprises the steps of:
- inserting the lower tab portion of the upper bracket member into the void in the top end of the lower bracket member;
- aligning at least one opening in the lower tab portion of the upper bracket member with at least one corresponding opening in a top area of the lower planar portion of the lower bracket member; and securing a fastener through the opening in the top area of the lower planar portion of the lower bracket member and through the opening in the lower tab portion of the upper bracket member.

17. The method of claim 15 further comprising the steps of:

providing at least one intermediate bracket member having:

an upper latch portion;

a top end with a void; and a lower planar portion; and a lower tab portion inserted into the void in the top end of the lower bracket member.

18. The method of claim 15 wherein the step of securing the bracket to the movable wall comprises the steps of:

inserting the lower tab portion of the intermediate bracket member into the void in the top end of the lower bracket member;

aligning at least one opening in the lower tab portion of the intermediate bracket member with at least one corresponding opening in a top area of the lower planar portion of the lower bracket member;

securing a threaded fastener through the opening in the top are of the lower planar portion of the lower bracket member and through the opening in the lower tab portion of the intermediate bracket member;

inserting the lower tab portion of the upper bracket member into the void in the top end of the intermediate bracket member;

aligning at least one opening in the lower tab portion of the upper bracket member with at least one opening in the lower planar portion of the intermediate bracket member; and securing a threaded fastener through the opening in the lower planar portion of the intermediate bracket member and the opening in the lower tab portion of the upper bracket member.

19. The method of claim 15 further comprising the steps of:

providing a cubicle wall start having at least one upper opening and at least one lower opening;

aligning at least one opening in the upper planar portion of the upper bracket member with the upper opening in the cubicle wall start;

aligning at least one opening in a bottom area of the lower planar portion of the lower bracket member with the lower opening in the cubicle wall start;

securing a fastener through the upper opening in the cubicle wall start and the opening in the upper planar portion of the upper bracket member; and securing a fastener through the lower opening in the cubicle wall start and the opening in the bottom area of the lower planar portion of the lower bracket member.

20. A bracket for supporting a cubicle wall on a movable wall having at least one horizontal mounting channel comprising:

a lower bracket member having:

an upper latch portion;

a top end with a void; and a lower planar portion; and an upper bracket member having:

an upper planar portion; and a lower tab portion inserted into the void in the top end of the lower bracket member;

wherein the lower tab portion of the upper bracket member has at least one opening that aligns with at least one corresponding opening in a top area of the lower planar portion of the lower bracket member when the lower tab portion of the upper bracket member is inserted into the void in the top end of the lower bracket member.

* * * * *